United States Patent [19]

Armantrout et al.

[11] Patent Number: 4,669,713

[45] Date of Patent: Jun. 2, 1987

[54] CLAMPLESS JIG FOR SERVICING AND REPAIRING SKIS

[76] Inventors: Henry M. Armantrout, 3062 S. 1640 W., Salt Lake City, Utah 84106; Peter W. Stuart, 367-10th Ave., Salt Lake City, Utah 84103

[21] Appl. No.: 798,083

[22] Filed: Nov. 14, 1985

[51] Int. Cl.[4] ..... B23Q 3/00

[52] U.S. Cl. ..... 269/43; 269/88; 269/286; 269/296; 269/906

[58] Field of Search ..... 269/906, 43, 88, 285, 269/286, 296

[56] References Cited

U.S. PATENT DOCUMENTS

| | | | |
|---|---|---|---|
| 2,377,904 | 6/1945 | Roach | 269/47 |
| 3,719,008 | 3/1973 | Mayers | 269/906 |
| 3,963,234 | 6/1976 | Bejtlich | 269/906 |
| 4,078,780 | 3/1978 | Schwarz | 269/906 |
| 4,081,180 | 3/1978 | Munn | 269/906 |
| 4,175,736 | 11/1979 | Dietlien | 269/906 |

*Primary Examiner*—Robert C. Watson

*Attorney, Agent, or Firm*—Lynn G. Foster

[57] ABSTRACT

A jig or bench for holding a ski in any one of several stationary positions for servicing and repair comprising a rigid frame without any moving parts or clamps, which provides three stable sites for stationarily supporting a ski in any one of a plurality of positions suitable for different servicing and maintenance operations.

4 Claims, 3 Drawing Figures

CLAMPLESS JIG FOR SERVICING AND REPAIRING SKIS

FIELD OF INVENTION

The present invention relates generally to jigs for holding skis in rigid positions for repair and service.

PRIOR ART

Jigs for immovably anchoring a ski in a rigid position for maintenance and service are known. Prior art jigs, however, most frequently incorporate a plurality of moving parts and require clamps, rendering the prior art jigs expensive to manufacture, difficult to maintain, time consuming to use and risking damage to the ski by use of the clamps. The various clamps and brackets provided in prior art jigs must be mechanically maintained and require manipulation by the service and repair person to secure a ski in position for work. Such complexity renders prior art jigs bulky, costly, complex and sometimes damaging.

BRIEF SUMMAY AND OBJECTS OF THE INVENTION

In brief summary, the present invention comprises a clampless jig for repairing and servicing skis. The jig has no moving parts. The ski is affixed in position by friction-generating structure and by a wedging action involving the ski. Either of two edges or the top or bottom of a ski may be held in an upright position for repair or servicing. The present invention further comprises a jig in which a ski can quickly and easily insert, remove or be repositioned in a minimum of time, without damage to one ski and without laborious effort.

With the foregoing in mind, it is a primary object of the present invention to provide a novel jig for repairing and servicing skis.

It is a further important object of the present invention to provide a jig for securing a ski during repair and service, wherein the jig has no clamps, mechanical devices or other moving parts.

A further paramount object of the present invention is to provide an inexpensive jig for securing a ski during service and repair wherein the ski is held in any one of several positions in the jig either by friction or by a wedging action.

A further principal object according to the present invention is the provision of a simple, inexpensive jig for servicing skis, wherein the ski may be variously positioned to serve the top, bottom or either edge thereof.

These and other objects and features of the present invention will be apparent from the detailed description taken with reference to the accompanying drawings.

DETAILED DESCRIPTION OF THE ILLUSTRATED EMBODIMENT

Figure 1:
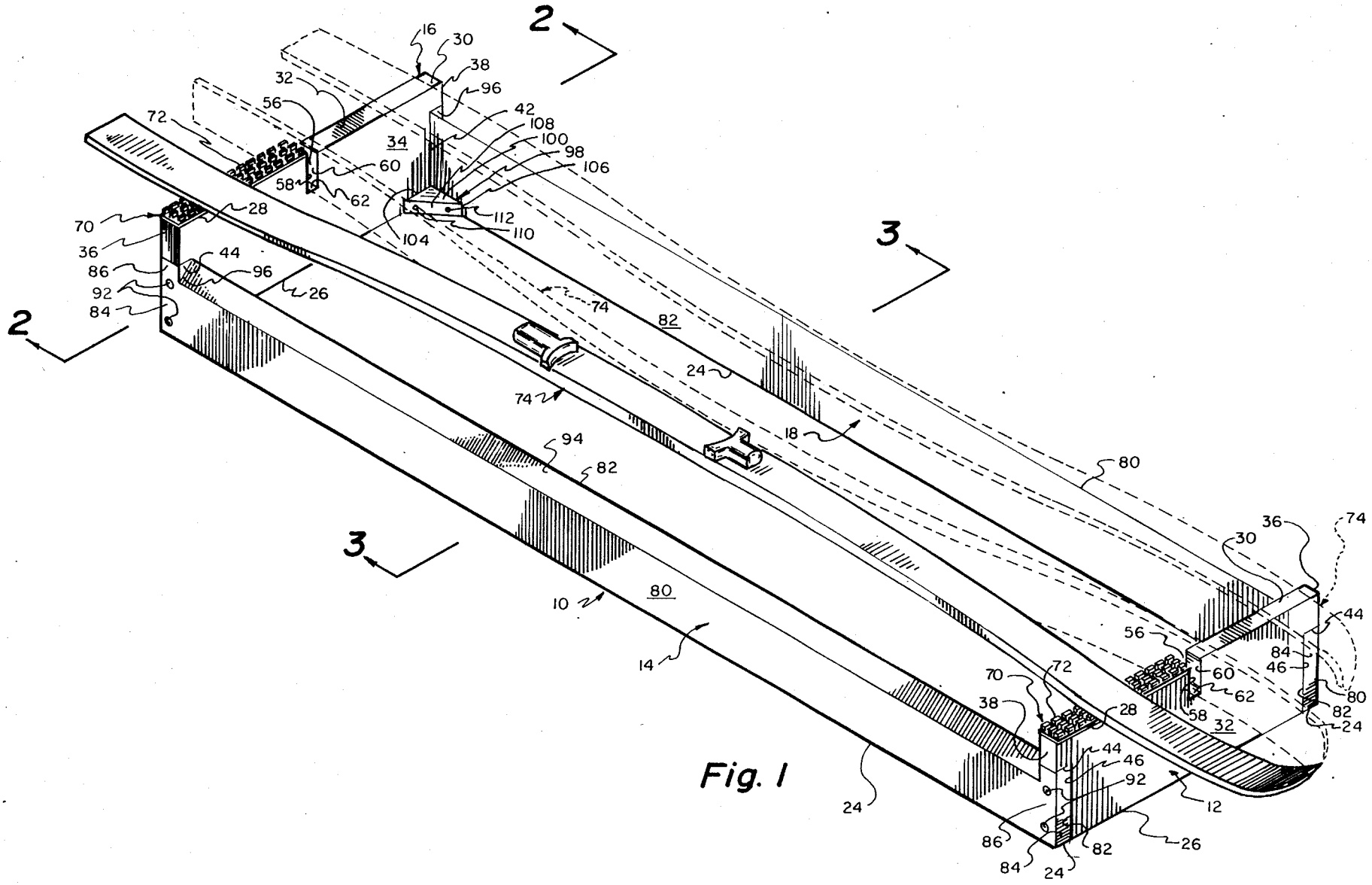
FIG. 1 is a perspective view of a presently preferred jig for servicing and repairing skis, fabricated according to the principles of the present invention.

Reference is now made to the drawings wherein like numerals are used throughout to designate like parts. FIG. 1 illustrates a presently preferred jig or bench constructed in accordance with the principles of the present invention and generally designated 10. The jig 10 is basically rectangular or box shaped for receiving a ski for repair and/or servicing and comprises opposed and spaced first and second vertically disposed end walls 12 and 16. The jig 10 further comprises opposed and spaced first and second vertically disposed side frame members 14 and 18.

Since the end walls 12 and 16 are identical, though of opposite hand, only one end wall will be described. Likewise, since the side frame members 14 and 18 are identical, though of opposite hand, only one side frame member will be described. When assembled, in the presently preferred and illustrated configuration, the bottom edge surface 26 of the two end members 12, 16 is disposed in a common horizontal plane also containing the bottom edge surface 24 of the two side frame members 14, 18. The vertical dimension of side frame members 14 and 18 is the same and reaches an elevation substantially lower than the top elevation of the end members 12 and 16, whereby easy side access to a ski being repaired or serviced is provided.

The two end frame members 12, 16 each comprise a generally solid rectangular body comprising a flat bottom edge surface 26, spaced flat top edge surfaces 28 and 30, an outside flat face 32 and an interior flat vertical face 34. The top edge surfaces 28 and 30 are in a common horizontal plane, as illustrated, and these surfaces are parallel to but offset from a plane containing each bottom surface 26. Likewise the exterior vertical surface 32 and the interior vertical surface 34 are contained within parallel vertical planes. Each end member 12, 16 also comprises opposite exposed flat side edges 36 and 38, which are vertically directed and are contained, respectively, in planes which are parallel one to the other.

The exposed side edge 38 merges with a horizontal shoulder surface 40. The width of the shoulder surface 40 is identical to the width of side member 18, for purposes hereinafter more fully explained. Shoulder surface 40 merges with a vertical edge surface 42, which is contained within a vertical plane and has a vertical dimension equal to the vertical dimension of the associated side member 18. The plane containing side edge 42 is parallel to but offset from the plane containing exposed side edge 38, the distance between said two planes being equal to the thickness or width to the side member 18.

In like fashion, the exposed vertical edge surface 36 merges with shoulder surface 44, the width of which is equal to the width of the side member 14. Shoulder surface 42 is contained within a horizontal plane which also contains shoulder 40. Shoulder surface 44 merges with vertically directed edge surface 46, the vertical dimension of which is equal to the vertical dimension of side frame member 14. Side edge surface 46 is contained within a vertical plane which is parallel to a vertical plane containing exposed side edge surface 36 and spaced therefrom by distance equal to the width or thickness of the side member 14.

Side edge surface 42 and side edge surface 36 are respectively interrupted by spaced blind bores 48 and 50 and 52 and 54, respectively. The blind bores 48, 50, 52 and 54 are for the purpose of receiving dowel fasteners, as hereinafter more fully explained.

The top edge surfaces 28 and 30 of each end frame member 12, 16 are separated by a vertical slot 56. Each vertical slot 56 comprises spaced parallel vertical side walls 58 and 60, each of which merges with a horizontal base wall 62 to form the slot 56. The vertical dimension 64 of the slot 56 is uniform and selected so as to be somewhat less than the width of a ski to be repaired or serviced so that when the ski is placed on one edge thereof in the aligned slots 56 of the two end members, the other ski edge will project upwardly well above the top edge surfaces 28 and 30. The width 66 of each slot 56 is uniform and selected so that it is greater than the minimum thickness of the illustrated cambered ski (FIG. 1) and less than the maximum thickness of the ski, to facilitate both insertion and retention of the ski in the aligned slots 56 by a wedging action, as hereinafter more fully explained.

As can be seen best from an inspection of FIG. 1, the top surface 30 of each of the end members is exposed and adapted to contiguously receive the top surface of the ski. However, the top edge surface 28 of each of the two end members 12, 16 is concealed by an anti-displacement pad, generally designated 70. The pad 70 is rectangular and covers the entirety of each of the two top edge surfaces 28. Each pad 70 is adhesively or otherwise suitably bonded to or secured upon said surfaces 28, so as to be integral therewith. Thus, the two pads 70 are longitudinally aligned.

Each pad 70 comprises a suitable durable high-friction elastomeric material, such as a segment of reinforced conveyer belt material having an exposed upper surface tread 72. Other suitable materials, of course, can be used as anti-displacement pads so that a ski, when placed longitudinally across the two pads 70, either with the top surface or bottom surface up, will be restrained by the high degree of friction provided by the pads 70 against logitudinal or transversed displacement or a combination of the two. Thus, the two pads, at the upper tread surface 72 thereof, create an anti-displacement frictional force inhibiting horizontal motion of the ski 74 resting thereon while work is being performed thereon.

It is presently preferred that the end members 12, 16 be formed of kiln dried wood, sanded on the four sides, although other suitable material including metal and/or synthetic resinous material, which are shape-retaining and of sufficient structural integrity to accept the loads imposed upon the jig 10, may be used.

Since the side frame members 14, 18 are identical, though of opposite hand, only one will be described here. Each side frame member 12, 18 is substantially elongated and, when assembled to form the jig 10, extends in a longitudinal direction. Each side frame 14, 18 is generally rectangular in configuration and formed of solid shape-retaining material such as wood, sanded on four sides, or a suitable metal or synthetic resinous material which is shape-retaining and sufficiently strong to carry the loads imposed thereon when assembled to form the jig 10. Each side frame member 14, 18 comprises an exposed flat exterior side surface 80 and a flat interior side surface 82, in addition to the heretofore described horizontal flat bottom edge surface 24. The side surfaces 80 and 82 of each side frame member 14, 18 are vertically directed and are parallel to each other, spaced by a distance equal to the width of shoulders 40 and 44, hereinbefore described. The bottom 24 of each frame member 14, 18 transversely merges with and connects the two parallel, vertically directed side walls 80 and 82. Each side frame member 14, 18 comprises two end edges 84, each of which also merges at 90° with side wall surface 80 and 82. In the assembled condition illustrated in FIG. 1, each end edge 84 is disposed in flush relationship to the associated exterior vertical surface 32 of the associated end member 12, 16.

Figure 2:
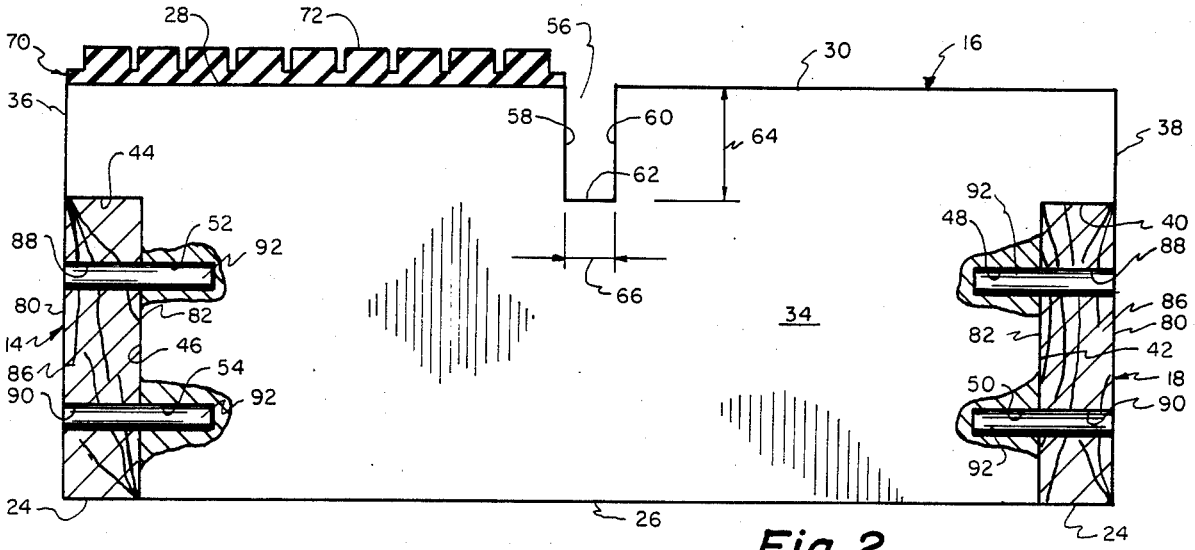
FIG. 2 is a cross-sectional view of the jig taken along lines 2—2 of FIG. 1.
Figure 3:
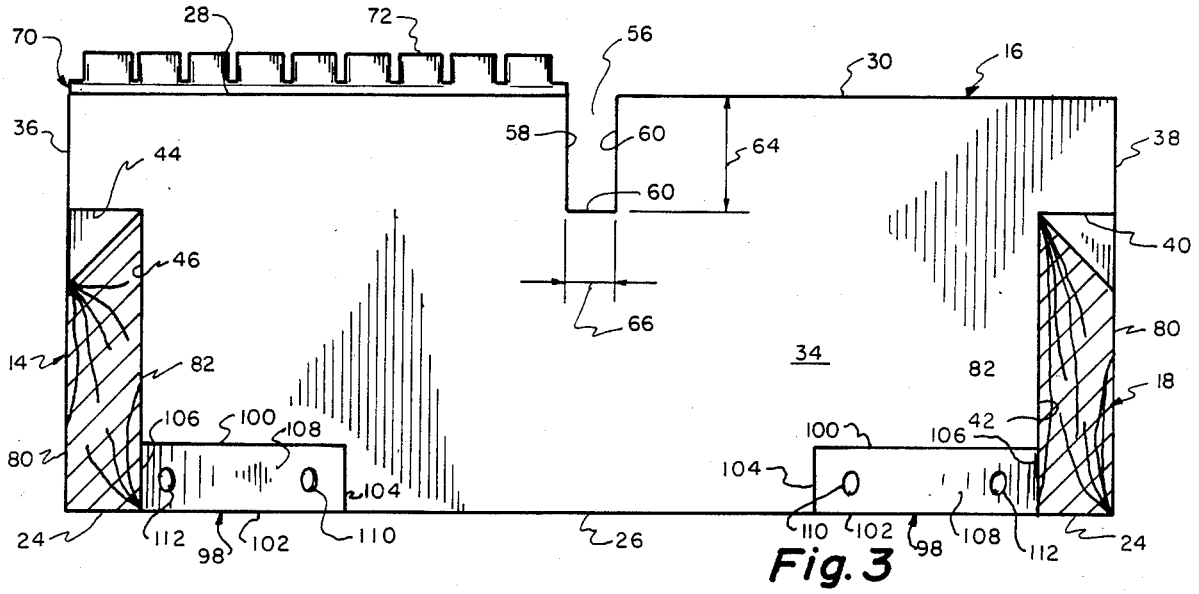
FIG. 3 is a cross-sectional view of the jig taken along lines 3—3 of FIG. 1.

The four end edges 84 are rectangular in configuration, as are the two end portions 86 of each side member 14, 18. Each end section 86, of which there are four, is sized and shaped so as to be snugly received at the associated shoulder surface 40, 42 and side edge surface 44, 46. Thus, the respective end sections 86 are contiguous with the adjacent vertical end member side surface 42, 46, and contiguous with the adjacent shoulder surface 40, 44. Accordingly, the exterior surface 80 is flush with the associated side edge surface 36, 38, as best illustrated in FIG. 2.

Each end section 86 comprises top and bottom transverse apertures 88 and 90. The diameter of the apertures 88 and 90 is the same as the diameter of the blind bores 48, 50, 52 and 54. Each aperture 88, 90 is aligned with one of the blind bores 48, 50, 52 and 54. In the assembled condition, a cylindrical dowel fastener 92 is fitted snugly with and adhesively secured to the walls of each associated pairs of apertures 88, 90 and blind bore 48, 50, 52, 54 so that the exposed end of each dowel fastener 92 is flush with the side frame surface 80. See FIG. 2. The dowel fasteners 92, in the illustrated configuration, are disposed in a horizontal orientation. The joint between the end frame member and the side frame members is illustrated as being a lap joint. Other joints, such as dove tail, miter, hidden miter, etc., may be use, without departing from the spirit of the present invention. Likewise, the use of dowels as fasteners to join the frame members one to another is not critical. Other fasteners, well-known to those skilled in the art, may be used.

Each exterior side surface 80 and the interior side surface 82 of each side frame member 14, 18 are connected one to another by a sloped or diagonally disposed top surface 94, which is intentionally so oriented and caused to be smooth to avoid injury or harm to the user of the jig 10. The sloped surface 94 merges with each end segment 86 across a triangular surface 96. Each triangular surface 96 is vertically directed and is contained with in the same vertical plane as is the interior surface 34 of each end frame member 12, 16.

The joint between each end wall 12, 16 and the adjacent side frame member 14, 18 is retained square or in a right angle position by a gusset plate 98 at each such joint. Since the gussets 98 are identical, only one gusset will be described. The gusset comprises a top flat triangular surface 100, a spaced bottom flat triangular surface 102, a rectangular flat end wall surface 104, a rectangular flat side frame surface 106, and a rectangular flat interior surface 108. The top surface 100 and the bottom surface 102 are disposed in parallel horizontal but offset planes. The end wall surface 102 and the side frame surface 104 are disposed in vertical planes and are joined to each other and to the top surface 100 and bottom surface 102 at right angles. The interior surface 108 is disposed in a vertical plane and is joined to the top surface 100 and the bottom surface 102 at right angles and is joined to the end wall surface 102 and the side frame surface 104 at acute angles.

The wall surface 104 is joined to the interior vertical face 34 of the end frame member 12, 16 with a suitable adhesive and a fastener, such as a nail 110. The side frame surface 106 is joined to the interior side surface 82 of a side frame member 14, 18 by a suitable adhesive and a fastener such as a nail 112.

The gussets 98 resist deforming shear stresses. Other gussets, well known to those skilled in the art, such as angle irons, may be used without departing from the spirit of the invention.

From the foregoing, it should be readily apparent that the presently preferred embodiment of the present invention, in the form of the jig or bench 10, comprises a rigid frame which does not require clamps or other moving parts and yet provides three separate locations for servicing and/or repairing a ski. Thus, the present invention uniquely addresses the requirement and need for easy turning of skis. The device holds the ski in place for easy scraping, flat and edge filing and waxing. It is preferably light-weight, portable and does not need to be pre-assembled. That is, it may be shipped in a disassembled condition and assembled at the site where it is intended to be used. Once assembled, it may be used on any flat surface.

To file the edges, the ski is placed on one edge in the aligned slots 56, care being taken to make certain that the portion of the skis so placed in the slots has a thickness less than the width of the slots 66. In this condition, one edge of the ski will be elevated substantially above the jig or bench 10. Thereafter, the ski is longitudinally displaced, either fore or aft, until the cambered portion of the ski having a thickness essentially the same as the slot width 66 is disposed within one slot 56, whereupon a slight additional displacement will cause the ski to wedge, without damage, in the slot 56. Ordinarily, the wedging action is created at only one of the two slot sites. Therefore, as the edge of the ski is filed, filing should take place in the direction in which the ski was advanced to create the wedging action.

When flat filing, scraping, buffing, and the application of hard waxes is desired, the ski is placed top down across the two pads 70. The ski in this position should be adjusted for maximum stability and the downward pressure used in filing, scraping, buffing and the application of hard waxes is sufficient to create an anti-displacement friction at pads 70 to thereby retain the ski in a stable position while the work is performed.

Preferably, hot waxing is applied after the ski is placed across the two top edge surfaces 30 in a stable position, following which the hot wax is conventionally applied. It is preferred that hot waxing not be performed while the ski is located on the pads 70 because the wax will destroy the gripping action of the pads.

The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A clampless unitary jig for supporting a ski during servicing and repair comprising:

first stationary means defining a first location for servicing a ski, said first stationary means comprising two spaced support site means which respectively frictionally and clamplessly support one end of the ski in said first servicing location, each said support site means comprising exposed anti-displacement means upon which the ski gravitationally rests;

second stationary means defining a second location for servicing the ski, said second stationary means comprising two spaced support site means which respectively clamplessly secure one end of the ski in the second ski servicing location, each said support site means comprising exposed spaced aligned slot means sized and shaped to accommodate releasable wedging of the ski into the two slot means without imposing twisting flexure or torque stresses to the ski;

third stationary means defining a third location for servicing the ski, said third stationary means comprising two spaced support site means which respectively clamplessly support one end of the ski in the third ski servicing location, each said support site means comprising at least two spaced surfaces which are not susceptible to permanent contamination by being inadvertently subjected to hot wax; and means joining all of the aforementioned first, second and third stationary means into a unitarily stable structure which is stationary, used without moving parts and parts of which are not adjusted during use.

2. A clampless jig according to claim 1 wherein one of each said support means of the first, second and third stationary means are integrally joined together in transversely juxtaposed relation and wherein the other of said support means of the first, second and third stationary means are integrally joined together in transversely juxtaposed relations.

3. A jig according to claim 1 wherein each anti-displacement means comprise an exposed elastomeric substance upon which the ski is intended to gravitationally rest.

4. A jig according to claim 1 wherein the slot means comprise spaced side wall means separated by a distance which is less than a maximum thickness of the ski and greater than a minimum thickness of the ski, the length of each side wall means being less than the width of the ski whereby the ski may be placed on one edge thereof in wedged relation within the slot means so that the other ski edge projects above the slot for performance of work thereon.

* * * * *